US006691890B1

(12) United States Patent
Persson

(10) Patent No.: US 6,691,890 B1
(45) Date of Patent: Feb. 17, 2004

(54) BEVERAGE HOLDING PLATE

(76) Inventor: Bjorn Olaf Hjalmar Persson, Danderydsgatan 30 114 26, Stockholm (SE)

( * ) Notice: Subject to any disclaimer, the term of this patent is extended or adjusted under 35 U.S.C. 154(b) by 0 days.

(21) Appl. No.: 10/089,613

(22) PCT Filed: Aug. 3, 2000

(86) PCT No.: PCT/SE00/01540

§ 371 (c)(1),
(2), (4) Date: Apr. 1, 2002

(87) PCT Pub. No.: WO02/11586

PCT Pub. Date: Feb. 14, 2002

(51) Int. Cl.[7] ..... B65D 1/36; A61G 19/00
(52) U.S. Cl. ..... 220/575; 220/574
(58) Field of Search ..... 220/575, 574, 220/570

(56) References Cited

U.S. PATENT DOCUMENTS

| | | | | |
|---|---|---|---|---|
| 421,264 | A | 2/1890 | Gibbons | |
| 3,401,858 | A | 9/1968 | White et al. | 224/48 |
| RE27,688 | E | 6/1973 | White et al. | 224/48 |
| 4,219,144 | A | 8/1980 | Hagelberg | 229/2.5 |
| 4,461,396 | A | 7/1984 | Harper | 220/23.83 |
| 4,607,758 | A | 8/1986 | Stevens | 220/23.83 |
| 4,744,597 | A | 5/1988 | Bauman et al. | 294/172 |
| 4,966,297 | A | 10/1990 | Doty | 220/23.83 |
| 4,989,742 | A | 2/1991 | Powell | 220/23.4 |
| 5,111,960 | A | 5/1992 | Zilliox | 220/575 |
| 5,152,398 | A | 10/1992 | Forestal et al. | 206/561 |
| 5,184,750 | A | 2/1993 | Moller | 220/575 |
| 5,207,743 | A | 5/1993 | Cosarella et al. | 220/574 |
| 5,234,125 | A | 8/1993 | Roberts | 220/574 |
| 5,323,910 | A | 6/1994 | van de Graaf, Jr. | 206/557 |
| 5,346,070 | A | 9/1994 | McSpadden | 206/561 |
| 5,390,798 | A | 2/1995 | Yanuzzi | 206/562 |
| 5,419,455 | A | 5/1995 | Russeau | 220/575 |
| 5,542,577 | A | 8/1996 | Friedrich | 220/759 |
| D373,933 | S | 9/1996 | Gibbs, III | D7/555 |
| 5,551,593 | A | 9/1996 | Wiens | 220/575 |
| 5,607,077 | A | 3/1997 | Torkelson | 220/575 |
| 5,678,694 | A | 10/1997 | Tanaka et al. | 206/561 |
| D386,048 | S | 11/1997 | Bebawey | D7/549 |
| 5,727,678 | A | 3/1998 | Chen | 206/217 |
| D398,481 | S | 9/1998 | Brown et al. | D7/554 |
| 5,947,011 | A | 9/1999 | Xu | 99/357 |
| 5,960,982 | A | 10/1999 | Perlis et al. | 220/574 |
| 6,021,914 | A | 2/2000 | Schmidt | 220/574 |
| 6,062,418 | A | 5/2000 | Rathjen | 220/574 |
| 6,129,235 | A | 10/2000 | Creske | 220/575 |
| 6,149,027 | A | 11/2000 | Rathjen | 220/574 |
| D448,977 | S | 10/2001 | Bleimaier et al. | D7/553.6 |
| D453,891 | S | 2/2002 | Sussman | D7/550.1 |
| D455,316 | S | 4/2002 | Carpenter | D7/549 |

FOREIGN PATENT DOCUMENTS

| | | |
|---|---|---|
| FR | 2736527 | 1/1997 |
| GB | 1377826 | 12/1974 |
| SE | 9801587-8 | 11/1999 |

*Primary Examiner*—Joseph Man-Fu Moy
(74) *Attorney, Agent, or Firm*—Westman, Champlin & Kelly

(57) ABSTRACT

In different situations it is desired to be able to both eat food and drink beverage without sitting at a table or having other access to flat surfaces upon which to place the plate and beverage container. This desirability has been solved by the design of a plate with at least one section (7) for food and another separate section (1) for placement of a beverage container (6), with the transition space between the two creating a recessed area on the bottom side (9) which together with the plate's outer edge (3) produces a handle which makes it possible with just one hand to hold both the plate and the beverage container so that the other hand is free to eat food with fingers or utensils, or pick up the beverage container, or used for some other task.

7 Claims, 1 Drawing Sheet

BEVERAGE HOLDING PLATE

Priority is hereby claimed under 35 U.S.C. §119 on International Application PCT/SE00/01540, filed Aug. 3, 2000, which International Application was published in English as number WO 02/11586.

BACKGROUND OF THE INVENTION

The discovery is a plate for holding food and drink. The plate is well suited for eating and drinking under such conditions where a table, countertop or other resting area is not available for the plate or beverage container.

At buffets, pot luck get-togethers, concert intermissions, wine and snacks, hors doevres, or fast-food situations, food is often served on plates of plastic, paper or porcelain. In these situations, drink is often served in a glass, cup, or directly in a bottle or can. The user is then faced with the problem of holding a plate with one hand and a cup/glass or beverage container with the other hand. In order to eat the contents on the plate, the other hand must be freed up. In these situations it is obviously a problem if a resting place does not exist for the plate or the beverage container.

A product already exists on the market wich one can fasten to the porcelain plate, or a plate having a hard outher edge made from other material. This other product is formed so that a glass with a foot can hang near the plate's outher edge, and the user can therefore flee a hand so that the freed hand can be used to cat food from the plate.

There also exists on the market, plates, usually of paper, which have a holder formed in the plate so that a paper cup, plastic cup or aluminium beverage can be snugly captured by a fitted hole slightly smaller than the beverage container diameter, thus allowing the user to free a hand to eat food from the same plate.

The following problems exist for the above mentioned existing products: they can only be used for certain limited types of beverage containers; the first product mentioned is designed only for a glass with a foot, because the glass must first fit into the limited holding space with the foot balancing as counterweight to the contents located in the upper part of the footed beverage container; the second product is designed for only a special type of cup or container with a very narrow diameter range. Both are relatively unstable in holding a beverage container during walking in crowded areas, and the user risks the chance of tipping the beverage container with a slight bump of an elbow.

SUMMARY OF THE INVENTION

Until now it has been in many situations a problem to eat food and drink beverages where tables, counters or other flat areas are not available. This discovery is a plate wich can hold steady a beverage container, with the use of only one hand, without the risk that the glass, cup bottle or can loses balance or tips. At the same time, the beverage container can be removed and used in a simple and easy way.

This object is fulfilled with the plate of the present invention, which meets the conditions described herein.

DETAILED DESCRIPTION OF THE PREFERRED EMBODIMENTS

Figure 1:
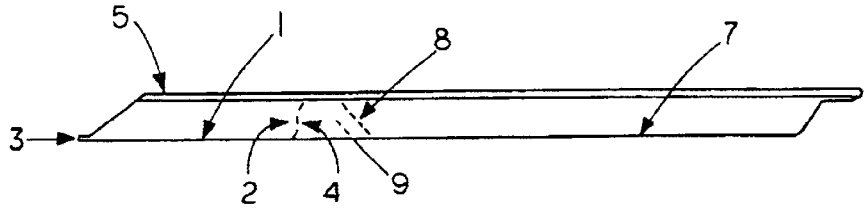
FIG. 1 is a side view of a plate made according to the invention.
Figure 2:
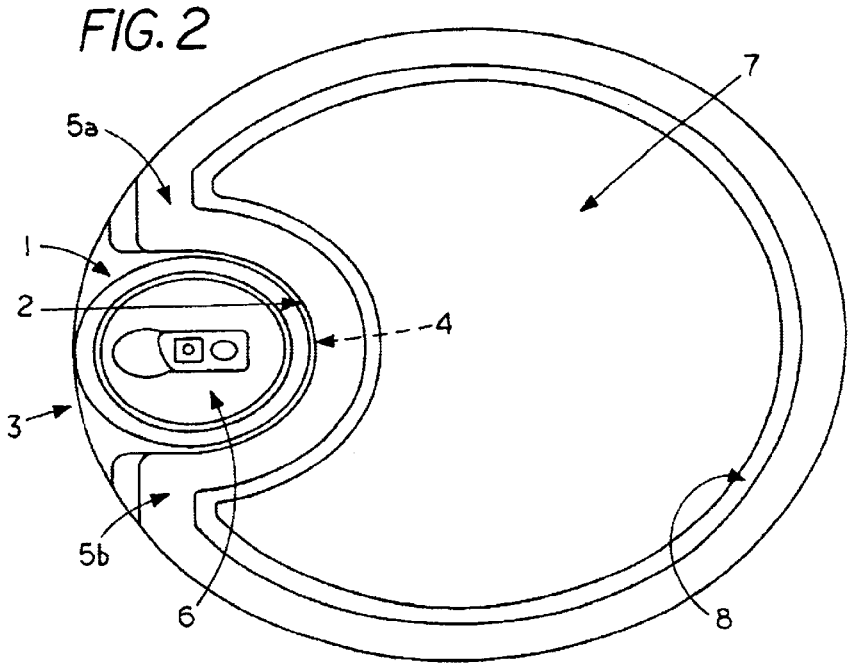
FIG. 2 is a top view of the plate with a beverage can of normal design placed on the plate.

In FIG. 2, the plate is shown with a flat area 1 on one side of the plate on which a beverage can 6 can rest, The inner edge of space 1 is curved and separated from the food space 7 by a wall 2. Wall 2 is curved with a diameter which allows space for a beverage container 6 of normal dimensions, The flat area 1 has an edge 3 that provides a space to rest the heel of the hand which holds the plate, and that hand's fingers are positioned below the plate so they can grab the recessed surface 4 formed by wall 2. The thumb rests nearly on the surface 5*a* for a right handed user, or respectively 5*b* for a left handed user. The distance between the edge 3 and wall 2 is such that the hand can with relative ease exert pressure on the beverage cup, can or bottle against wall 2. With a footed wine glass the thumb can rest on top of the foot to hold it on flat area 1.

Figure 3:
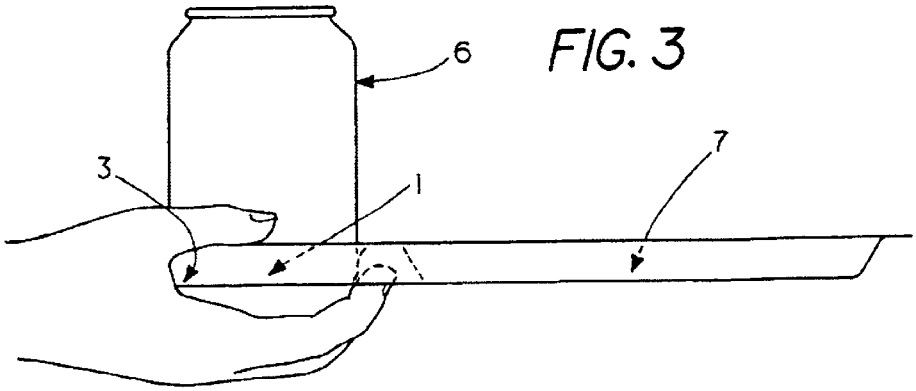
FIG. 3 shows the plate from the side, with a beverage can and a user's hand which holds the plate while exerting some pressure on the beverage can.

The space 7 is designed for food, and the plate has a raised edge wall 8 that joins wall 2, and which holds food on the plate. A recess 9 is formed between wall surface 4 and the inner surface edge of wall 8 on the bottom of the plate. It can be seen in FIG. 3 that the fingers fit into the recess 9 for gripping.

The plate is suitable to be made in plastic or pressed paper or other suitable material. The advantage of this is that the plate can be mass produced at a low price and be a disposable one-time product. The plate must be stiff enough so that when held by one hand from the underside the food weight does not cause it to bend.

Although the present invention has been described with reference to preferred embodiments, workers skilled in the art will recognize that changes may be made in form and detail without departing from the spirit and scope of the invention.

What is claimed is:

1. A plate for food and beverage having a periphery and at least a first area for placement of food and second area having a support surface for placement of a beverage container, a raised wall raised above the support surface between the first and second areas, the raised wall forming a U-shape with an inner end forming a restraint for the beverage container at a location spaced inwardly from the periphery of the plate and the raised wall having spaced side wall portions extending from the inner end to the periphery of the plate to at least partially define the second area, the support surface forming a flat surface within the region defined by the U-shaped raised wall and extending out to the periphery between the spaced side wall portions, the underside of the plate having a concave gripping area underlying the raised wall, the concave area being formed to act as a gripping area for fingers of a gripping hand of a person holding the plate when the plate is held from underneath positioned so a thumb and a portion of the hand can simultaneously curl around a peripheral edge of the plate and exert pressure against both the top of the plate and the beverage container between the spaced side wall portions.

2. The plate for food and beverage as specified in claim 1, wherein the end of the U-shape of the raised wall is part circular.

3. The plate for food and beverage of claim 1 wherein the plate has a bottom surface in the first and second areas, and the bottom surfaces of the first and second areas substantially planar.

4. The plate for food and beverage as specified in claim 3, wherein said concave gripping area extends upwardly from the plane of the bottom surface to form the raised wall and separate the first and second areas on the plate.

5. The plate for food and beverage as specified in claim 1, wherein the raised wall separates the first and second areas of the plate, and the raised wall has a wall portion that surrounds a major portion of the periphery of the plate, such that the first area is recessed below upper portions of the raised wall.

6. The plate for food and beverage of claim 1, wherein the space between the spaced side wall portions of the raised wall is of size to provide for space for portion of a hand to be placed on an upper surface of the flat area with the fingers in the recessed area, and a thumb on one of the side wall portions of the raised wall.

7. A plate for food and beverage having at least a first recessed area for placement of food and utensils and a second area having a flat upper surface for placement of a beverage container, the first and second areas being separated by a raised wall for restraint of a beverage container, the raised wall having an inner portion spaced inwardly from a periphery of the plate and leaving the flat surface of the second area unobstructed to the periphery between spaced raised side walls joining the inner portion, the raised inner portions forming a concave gripping area on an underside of the plate of size to receive fingers of a user and the concave gripping area being positioned so that a thumb of a user can be placed over an edge of the plate for gripping the plate with a portion of the hand overlying the flat surface between the spaced raised side walls.

* * * * *